US009449604B2

(12) United States Patent
Virette et al.

(10) Patent No.: US 9,449,604 B2
(45) Date of Patent: Sep. 20, 2016

(54) METHOD FOR DETERMINING AN ENCODING PARAMETER FOR A MULTI-CHANNEL AUDIO SIGNAL AND MULTI-CHANNEL AUDIO ENCODER

(71) Applicant: Huawei Technologies Co., Ltd., Shenzhen, Guangdong (CN)

(72) Inventors: David Virette, Munich (DE); Yue Lang, Beijing (CN); Jianfeng Xu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 182 days.

(21) Appl. No.: 14/498,625

(22) Filed: Sep. 26, 2014

(65) Prior Publication Data

US 2015/0010155 A1 Jan. 8, 2015

Related U.S. Application Data

(63) Continuation of application No. PCT/EP2012/056340, filed on Apr. 5, 2012.

(51) Int. Cl.
*G10L 19/008* (2013.01)

(52) U.S. Cl.
CPC ..... *G10L 19/008* (2013.01)

(58) Field of Classification Search
CPC ..... G10L 19/008
USPC ..... 381/23, 2, 17–18, 97–98, 100; 704/500, 704/200, 501, 278
See application file for complete search history.

(56) References Cited

U.S. PATENT DOCUMENTS

2006/0004583 A1 1/2006 Herre et al.
2009/0222272 A1 9/2009 Seefeldt et al.

(Continued)

FOREIGN PATENT DOCUMENTS

CN 1954642 A 4/2007
CN 101410889 A 4/2009

(Continued)

OTHER PUBLICATIONS

Japanese Patent Office, Office Action in Japanese Patent Application No. 2015- 503766 (Oct. 27, 2015).

(Continued)

*Primary Examiner* — Melur Ramakrishaiah
(74) *Attorney, Agent, or Firm* — Leydig, Voit & Mayer, Ltd.

(57) ABSTRACT

The invention relates to a method for determining an encoding parameter for an audio channel signal of a multi-channel audio signal, the method comprising: determining for the audio channel signal a set of functions from the audio channel signal and a reference audio signal; determining a first set of encoding parameters based on a smoothing of the set of functions with respect to a frame sequence of the multi-channel audio signal, the smoothing being based on a first smoothing coefficient; determining a second set of encoding parameters based on a smoothing of the set of functions with respect to the frame sequence of the multi-channel audio signal, the smoothing being based on a second smoothing coefficient; and determining the encoding parameter based on a quality criterion with respect to the first set of encoding parameters and/or the second set of encoding parameters.

16 Claims, 9 Drawing Sheets

(56) References Cited

U.S. PATENT DOCUMENTS

| | | | | |
|---|---|---|---|---|
| 2011/0235810 | A1* | 9/2011 | Neusinger | G10L 19/26 381/23 |
| 2015/0131801 | A1 | 5/2015 | Neusinger et al. | |

FOREIGN PATENT DOCUMENTS

| | | | |
|---|---|---|---|
| JP | 2008511849 | A | 4/2008 |
| KR | 20110095339 | A | 8/2011 |
| WO | WO 2006091150 | A1 | 8/2006 |
| WO | WO 2006108456 | A1 | 10/2006 |
| WO | WO 2007016107 | A2 | 2/2007 |

OTHER PUBLICATIONS

Faller et al., "Efficient Representation of Spatial Audio Using Perceptual Parametrization," IEEE Workshop on Applications of Signal Processing to Audio and Acoustics, pp. W2001-1-W2001-4, Institute of Electrical and Electronics Engineers, New York, New York, (Oct. 21-24, 2001).

Baumgarte et al., "Estimation of Auditory Spatial Cues for Binaural Cue Coding," IEEE International Conference on Acoustics, Speech and Signal Processing, pp. II-1801-11-1804, Institute of Electrical and Electronics Engineers, New York, New York, (May 13-17, 2002).

Breebaart et al., "Parametric Coding of Stereo Audio," EURASIP Journal on Applied Signal Processing, vol. 9, pp. 1305-1322, Springer Publishing, New York, New York (Jun. 21, 2005).

"Series G: Transmission Systems and Media, Digital Systems and Networks; Digital terminal equipments—Coding of voice and audio signals; Wideband embedded extension for G.711 pulse code modulation; Amendment 5: New Appendix IV extending Annex D superwideband for mid-side stereo," Recommendation ITU-T G.711.1 (2008)—Amendment 5, pp. i-3, International Telecommunication Union, Geneva, Switzerland (Mar. 2011).

"Series G: Transmission Systems and Media, Digital Systems and Networks; Digital terminal equipments—Coding of voice and audio signals; 7kHz audio-coding within 64 kbit/s; Amendment 2: New Appendix V extending Annex B superwideband for mid-side stereo," Recommendation ITU-T G.722 (1988)—Amendment 2; pp. i-3, International Telecommunication Union, Geneva, Switzerland (Mar. 2011).

* cited by examiner

200

300

METHOD FOR DETERMINING AN ENCODING PARAMETER FOR A MULTI-CHANNEL AUDIO SIGNAL AND MULTI-CHANNEL AUDIO ENCODER

CROSS-REFERENCE TO RELATED APPLICATION

This application is a continuation of International Patent Application No. PCT/EP2012/056340, filed Apr. 5, 2012, which is hereby incorporated by reference in its entirety.

TECHNICAL BACKGROUND

The present disclosure relates to audio coding and in particular to parametric multi-channel or stereo audio coding also known as parametric spatial audio coding.

Parametric stereo or multi-channel audio coding as described e.g. in C. Faller and F. Baumgarte, "Efficient representation of spatial audio using perceptual parametrization," in Proc. IEEE Workshop on Appl. of Sig. Proc. to Audio and Acoust., October 2001, pp. 199-202, uses spatial cues to synthesize multi-channel audio signals from down-mix—usually mono or stereo—audio signals, the multi-channel audio signals having more channels than the down-mix audio signals. Usually, the down-mix audio signals result from a superposition of a plurality of audio channel signals of a multi-channel audio signal, e.g. of a stereo audio signal. These less channels are waveform coded and side information, i.e. the spatial cues, related to the original signal channel relations is added as encoding parameters to the coded audio channels. The decoder uses this side information to re-generate the original number of audio channels based on the decoded waveform coded audio channels.

A basic parametric stereo coder may use inter-channel level differences (ILD or CLD) as a cue needed for generating the stereo signal from the mono down-mix audio signal. More sophisticated coders may also use the inter-channel coherence (ICC), which may represent a degree of similarity between the audio channel signals, i.e. audio channels. Furthermore, when coding binaural stereo signals e.g. for 3D audio or headphone based surround rendering by using head-related transfer function (HRTF) filtering, an inter-aural time difference (ITD) may play a role to reproduce delay differences between the channels.

The inter-aural time difference (ITD) is the difference in arrival time of a sound 801 between two ears 803, 805 as can be seen from FIG. 8. It is important for the localization of sounds, as it provides a cue to identify the direction 807 or angle of incidence of the sound source 801 (relative to the head 809). If a signal arrives to the ears 803, 805 from one side, the signal has a longer path 811 to reach the far ear 803 (contralateral) and a shorter path 813 to reach the near ear 805 (ipsilateral). This path length difference results in a time difference 815 between the sounds arrivals at the ears 803, 805, which is detected and aids the process of identifying the direction 807 of sound source 801.

FIG. 8 gives an example of ITD (denoted as $\Delta t$ or time difference 815). Differences in time of arrival at the two ears 803, 805 are indicated by a delay of the sound waveform. If a waveform to left ear 803 comes first, the ITD 815 is positive, otherwise, it is negative. If the sound source 801 is directly in front of the listener, the waveform arrives at the same time to both ears 803, 805 and the ITD 815 is thus zero.

ITD cues are important for most of the stereo recording. For instance, binaural audio signal, which can be obtained from real recording using for instance a dummy head or binaural synthesis based on Head Related Transfer Function (HRTF) processing, is used for music recording or audio conferencing. Therefore, it is a very important parameter for low bitrate parametric stereo codec and especially for codec targeting conversational application. Low complexity and stable ITD estimation algorithm is needed for low bitrate parametric stereo codec. Furthermore, the use of ITD parameters, e.g. in addition to other parameters, such as inter-channel level differences (CLDs or ILDs) and inter-channel coherence (ICC), may increase the bitrate overhead. For this specific very low bitrate scenario, only one full band ITD parameter can be transmitted. When only one full band ITD is estimated, the constraint on stability becomes even more difficult to achieve.

When a parameter is estimated by using a cross-correlation, a cross spectrum or an energy, the rapid change of the estimation function may lead to unstable estimation of the parameter. The estimated parameter might change too quickly and too frequently from frame to frame, which is usually not wanted. This can be the case if the size of the frame is small which can lead to a non-reliable estimator of the cross-correlation. The instability problem will be perceived as a source which seems to be jumping from the left to right side and/or vice versa although the actual source does not change its position. The instability problem can also be detected by a listener even if the source position does not jump from left side to right side. Small source position changes over time are easily perceived by a listener and should then be avoided when the actual source is fixed.

For example, the inter-aural time difference (ITD) is an important parameter for parametric stereo codec. If the ITD is estimated in the frequency domain based on the computation of a cross correlation function, the estimated ITD is usually not stable over consecutive frames, even if the position of sound source is fixed and the real ITD is stable. Stability problems can be solved by applying a smoothing function to the cross-correlation before using it for the ITD estimation. However, when smoothing the cross-correlation, rapid changes of the actual ITD cannot be followed. Besides, a stable smoothing reduces the tracking behavior of quickly following ITD changes when the sound source or the listening position moves with respect to each other.

Another example is channel level difference (CLD) estimation. CLD is an important parameter for parametric stereo codec. If the CLD is estimated in the frequency domain based on the computation of the energy of each bin or sub-band, the estimated CLD is usually not stable over consecutive frames, even if the position of sound source is fixed and the real level difference is stable. Stability problems can be solved by applying a smoothing function to the energy before using it for the CLD estimation. However, when smoothing the energy, rapid changes of the actual CLD cannot be followed thereby reducing the tracking behavior of quickly following CLD changes when the sound source or the listening position move with respect to each other.

Finding the right smoothing coefficients which allow to quickly follow the ITD or CLD changes while keeping the ITD or CLD stable has shown to be impossible, especially when the correlation function has a poor resolution, for instance the frequency resolution of an FFT.

SUMMARY OF THE INVENTION

It is an object of the present disclosure to provide a concept for a multi-channel audio encoder which provides both, stable and fast parameter estimation.

This object is achieved by the features of the independent claims. Further implementation forms are apparent from the dependent claims, the description and the figures.

The present disclosure is based on the finding that applying both, a strong smoothing and a weak smoothing, also referred to as low smoothing, to the cross-correlation in case of ITD or to the energy in the case of CLD results in two different encoding parameters where one of them quickly follows ITD or CLD changes while the other one provides a stable parameter value over consecutive frames. By using a smart detection procedure depending on a quality criterion, such as a stability criterion, the resulting encoding parameter is both stable and quickly following the ITD or CLD changes.

A single evaluation of the correlation is not sufficient to obtain both stability, i.e. keeping consistent evaluation of the ITD parameter over time when the actual source does not move, and reactivity, i.e. to change the evaluation function very fast when the actual source is moving or when a new source with a different position appears in the audio scene. Having two different evaluation functions of the same parameter with different memory effect based on different smoothing factors allows to focus one evaluation on stability and the other one on reactivity. A selection algorithm is provided to select the best evaluation, i.e. the most reliable one. Aspects of the present disclosure are based on two versions of the same evaluation function with different smoothing factors. A quality or reliability criteria is introduced for the decision to switch from long term evaluation to short term evaluation. In order to benefit from both the short term evaluation and the long term evaluation, the long term status is updated by the short term status in order to cancel the memory effect.

In order to describe the present disclosure in detail, the following terms, abbreviations and notations will be used:

BCC: Binaural cues coding, coding of stereo or multi-channel signals using a down-mix and binaural cues (or spatial parameters) to describe inter-channel relationships.

Binaural cues: Inter-channel cues between the left and right ear entrance signals (see also ITD, ILD, and IC).

CLD: Channel level difference, same as ILD.

FFT: Fast implementation of the DFT, denoted Fast Fourier Transform.

HRTF: Head-related transfer function, modeling transduction of sound from a source to left and right ear entrances in free-field.

IC: Inter-aural coherence, i.e. degree of similarity between left and right ear entrance signals. This is sometimes also referred to as IAC or interaural cross-correlation (IACC).

ICC: Inter-channel coherence, inter-channel correlation. Same as IC, but defined more generally between any signal pair (e.g. loudspeaker signal pair, ear entrance signal pair, etc.).

ICPD: Inter-channel phase difference. Average phase difference between a signal pair.

ICLD: Inter-channel level difference. Same as ILD, but defined more generally between any signal pair (e.g. loudspeaker signal pair, ear entrance signal pair, etc.).

ICTD: Inter-channel time difference. Same as ITD, but defined more generally between any signal pair (e.g. loudspeaker signal pair, ear entrance signal pair, etc.).

ILD: Interaural level difference, i.e. level difference between left and right ear entrance signals. This is sometimes also referred to as interaural intensity difference (IID).

IPD: Interaural phase difference, i.e. phase difference between the left and right ear entrance signals.

ITD: Interaural time difference, i.e. time difference between left and right ear entrance signals. This is sometimes also referred to as interaural time delay.

ICD: Inter-channel difference. The general term for a difference between two channels, e.g. a time difference, a phase difference, a level difference or a coherence between the two channels.

Mixing: Given a number of source signals (e.g. separately recorded instruments, multitrack recording), the process of generating stereo or multi-channel audio signals intended for spatial audio playback is denoted mixing.

OCPD: Overall channel phase difference. A common phase modification of two or more audio channels.

Spatial audio: Audio signals which, when played back through an appropriate playback system, evoke an auditory spatial image.

Spatial cues: Cues relevant for spatial perception. This term is used for cues between pairs of channels of a stereo or multi-channel audio signal (see also ICTD, ICLD, and ICC). Also denoted as spatial parameters or binaural cues.

According to a first aspect, the present disclosure relates to a method for determining an encoding parameter for an audio channel signal of a plurality of audio channel signals of a multi-channel audio signal, each audio channel signal having audio channel signal values, the method comprising: determining for the audio channel signal a set of functions from the audio channel signal values of the audio channel signal and reference audio signal values of a reference audio signal, wherein the reference audio signal is another audio channel signal of the plurality of audio channel signals; determining a first set of encoding parameters based on a smoothing of the set of functions with respect to a frame sequence of the multi-channel audio signal, the smoothing being based on a first smoothing coefficient; determining a second set of encoding parameters based on a smoothing of the set of functions with respect to the frame sequence of the multi-channel audio signal, the smoothing being based on a second smoothing coefficient; determining the encoding parameter based on a quality criterion with respect to the first set of encoding parameters and/or the second set of encoding parameters.

According to a second aspect, the present disclosure relates to a method for determining an encoding parameter for an audio channel signal of a plurality of audio channel signals of a multi-channel audio signal, each audio channel signal having audio channel signal values, the method comprising: determining for the audio channel signal a set of functions from the audio channel signal values of the audio channel signal and reference audio signal values of a reference audio signal, wherein the reference audio signal is a down-mix audio signal derived from at least two audio channel signals of the plurality of multi-channel audio signals; determining a first set of encoding parameters based on a smoothing of the set of functions with respect to a frame sequence of the multi-channel audio signal, the smoothing being based on a first smoothing coefficient; determining a second set of encoding parameters based on a smoothing of the set of functions with respect to the frame sequence of the multi-channel audio signal, the smoothing being based on a second smoothing coefficient; determining the encoding parameter based on a quality criterion with respect to the first set of encoding parameters and/or the second set of encoding parameters.

The strongly smoothed version of the set of functions, e.g. the smoothing based on the first smoothing parameter makes the estimation stable. The weakly smoothed version of the set of functions, e.g. the smoothing based on the second smoothing parameter which is determined at the same time, makes the estimation following the real fast changes of the estimation parameter, i.e. the ITD or the CLD. Memory of the strongly smoothed version of the set of functions is updated by the weakly smoothed version of the set of functions thereby providing the optimum result with respect to tracking speed and stability. The decision which smoothed version to use is based on a quality metric of the first set and/or the second set of encoding parameters. Hence, both, stable and fast parameter estimation is provided.

In a first possible implementation form of the method according to the first aspect or according to the second aspect, the determining the set of functions comprises:

determining a frequency transform of the audio channel signal values of the audio channel signal; determining a frequency transform of the reference audio signal values of the reference audio signal; determining the set of functions as a cross spectrum or a cross correlation for at least each frequency sub-band of a subset of frequency sub-bands, each function of the set of functions being computed between a band-limited signal portion of the audio channel signal and a band-limited signal portion of the reference audio signal in the respective frequency sub-band the function of the set of functions is associated to.

When estimating the encoding parameter in frequency domain based on cross correlation, the stability of the encoding parameter estimation is increased. The set of functions can be processed for frequency sub-bands, thereby improving flexibility in choosing the encoding parameter and improving robustness against noise as a frequency sub-band is less noise sensitive than the full frequency band.

In a second possible implementation form of the method according to the first implementation form of the first aspect or according to the first implementation form of the second aspect, a frequency sub-band comprises one or a plurality of frequency bins.

The size of the frequency sub-bands can be flexibly adjusted thereby allowing using different encoding parameters per frequency sub-band.

In a third possible implementation form of the method according to the first aspect as such or according to the second aspect as such or according to any of the preceding implementation forms of the first aspect or according to any of the preceding implementation forms of the second aspect, the first and second sets of encoding parameters comprise inter channel differences, wherein the inter channel differences comprise inter channel time differences and/or inter channel level differences.

Inter channel differences can be used as spatial parameters to detect a difference between a first and a second audio channel of a multi-channel audio signal. The difference can be for example a difference in the arrival time such as inter-aural time difference or inter channel time difference or a difference in the level of both audio channels. Both differences are suited to be used as encoding parameter.

In a fourth possible implementation form of the method according to the first aspect as such or according to the second aspect as such or according to any of the preceding implementation forms of the first aspect or according to any of the preceding implementation forms of the second aspect, the determining the encoding parameter based on a quality criterion comprises determining a stability parameter, the stability parameter being used by the quality criterion.

The quality criterion can, for example, be based on a stability parameter thereby increasing stability of the encoding parameter estimation. Additionally or alternatively, the quality criterion can be based on a quality of experience (QoE) criterion for increasing the QoE for the user. The quality criterion can be based on a bandwidth criterion for efficiently using bandwidth when performing the audio coding.

In a fifth possible implementation form of the method according to the fourth implementation form of the first aspect or according to the fourth implementation form of the second aspect, the determining the encoding parameter comprises: determining a stability parameter of the second set of encoding parameters based on a comparison between consecutive values of the second set of encoding parameters with respect to the frame sequence; and determining the encoding parameter depending on the stability parameter.

By using a stability parameter the stability of the estimation is improved. Besides, the speed of estimation is increased because the smoothing of the cross correlation or of the energy can be reduced until the stability parameter indicates a loss of stability.

In a sixth possible implementation form of the method according to the fourth implementation form of the first aspect or according to the fourth implementation form of the second aspect, the stability parameter is based at least on a standard deviation of the second set of encoding parameters.

The standard deviation is easy to calculate and provides an accurate measure of stability. When standard deviation is small, the estimation is stable or reliable, when standard deviation is large, the estimation is unstable or non reliable.

In a seventh possible implementation form of the method according to the fourth implementation form of the first aspect or according to the fourth implementation form of the second aspect or according to the fifth implementation form of the first aspect or according to the fifth implementation form of the second aspect, the stability parameter is determined over one frame or over multiple frames of the multi-channel audio signal.

Determining the stability parameter over one frame of the multi-channel audio signal is easy to implement and has a low computational complexity while determining the stability parameter over multiple frames provides an accurate estimation for stability.

In an eighth possible implementation form of the method according to any of the fourth to the seventh implementation forms of the first aspect or according to any of the fourth to the seventh implementation forms of the second aspect, the determining the encoding parameter is determined based on a threshold crossing of the stability parameter.

When the stability parameter is below the threshold, the estimation is stable or reliable, while a stability parameter being above the threshold indicates an unstable or non reliable estimation.

In a ninth possible implementation form of the method according to the eighth implementation form of the first aspect or according to the eighth implementation form of the second aspect, the method further comprises: updating the first set of encoding parameters with the second set of encoding parameters if the stability parameter crosses the threshold.

By the updating the estimation of the first set of encoding parameters can be improved. When the stability parameter is above the threshold indicating a stable estimation, long term smoothing can be updated or replaced by short term smoothing thereby increasing the speed of estimation while maintaining stability.

In a tenth possible implementation form of the method according to the first aspect as such or according to the second aspect as such or according to any of the preceding implementation forms of the first aspect or according to any of the preceding implementation forms of the second aspect, the smoothing of the set of functions based on a first and a second smoothing coefficient is computed as an addition of a memory state of the first and the second smoothed version of the set of functions multiplied by a first coefficient based on the first and the second smoothing coefficient and the set of functions multiplied by a second coefficient based on the first and the second smoothing coefficient.

Such a recursive computation uses a memory to store past values of the first and the second smoothed version of the set of functions. Recursive smoothing is computational efficient as the number of additions and multiplications is low. Recursive smoothing is memory-efficient as only one memory state is required for storing the past smoothed set of functions, the memory state being updated in each computational step.

In an eleventh possible implementation form of the method according to the tenth implementation form of the first aspect or according to the tenth implementation form of the second aspect, the method further comprises: updating the memory state of the first smoothed version of the set of functions with the memory state of the second smoothed version of the set of functions if the stability parameter crosses the threshold.

By the updating the memory state of the first smoothed version of the set of functions with the memory state of the second smoothed version of the set of functions depending on the stability parameter, stability and speed of estimation is improved. When the stability parameter is above the threshold indicating a stable estimation, long term smoothing, i.e. the first smoothed version of the set of functions, can be updated or replaced by short term smoothing, i.e. the second smoothed version of the set of functions, thereby increasing the speed of estimation while maintaining stability.

In a twelfth possible implementation form of the method according to the first aspect as such or according to the second aspect as such or according to any of the preceding implementation forms of the first aspect or according to any of the preceding implementation forms of the second aspect, the first smoothing coefficient is higher than the second smoothing coefficient.

The first smoothing coefficient allows long term estimation while the second smoothing coefficient allows short term estimation, thereby enabling to discriminate between different smoothing results.

In a thirteenth possible implementation form of the method according to the first aspect as such or according to the second aspect as such or according to any of the preceding implementation forms of the first aspect or according to any of the preceding implementation forms of the second aspect, the smoothing of the set of functions is with respect to at least two consecutive frames of the multi-channel audio signal.

The smoothing is more accurate if two or more consecutive frames of the multi-channel audio signal are used.

In a fourteenth possible implementation form of the method according to the first aspect as such or according to the second aspect as such or according to any of the preceding implementation forms of the first aspect or according to any of the preceding implementation forms of the second aspect, the smoothing of the set of functions discriminates between positive values of the second set of encoding parameters and negative values of the second set of encoding parameters.

By discriminating between positive and negative values of the second set of encoding parameters, the estimation has a higher degree of precision.

In a fifteenth possible implementation form of the method according to the fourteenth implementation form of the first aspect or according to the fourteenth implementation form of the second aspect, the smoothing of the set of functions comprises: counting a first number of positive values of the second set of encoding parameters and a second number of negative values of the second set of encoding parameters over a number of frequency bins or frequency sub-bands.

Counting the positive and negative values allows to discriminate the second set of encoding parameters depending on their sign. Estimation speed is increased by that discrimination.

According to a third aspect, the present disclosure relates to a multi-channel audio encoder for determining an encoding parameter for an audio channel signal of a plurality of audio channel signals of a multi-channel audio signal, each audio channel signal having audio channel signal values, the multi-channel audio encoder comprising: a first determiner determining for the audio channel signal a set of functions from the audio channel signal values of the audio channel signal and reference audio signal values of a reference audio signal, wherein the reference audio signal is another audio channel signal of the plurality of audio channel signals; a second determiner for determining a first set of encoding parameters based on a smoothing of the set of functions with respect to a frame sequence of the multi-channel audio signal, the smoothing being based on a first smoothing coefficient; a third determiner for determining a second set of encoding parameters based on a smoothing of the set of functions with respect to the frame sequence of the multi-channel audio signal, the smoothing being based on a second smoothing coefficient; an encoding parameter determiner for determining the encoding parameter based on a quality criterion with respect to the first set of encoding parameters and/or the second set of encoding parameters.

According to a fourth aspect, the present disclosure relates to a multi-channel audio encoder for determining an encoding parameter for an audio channel signal of a plurality of audio channel signals of a multi-channel audio signal, each audio channel signal having audio channel signal values, the multi-channel audio encoder comprising: a first determiner determining for the audio channel signal a set of functions from the audio channel signal values of the audio channel signal and reference audio signal values of a reference audio signal, wherein the reference audio signal is a down-mix audio signal derived from at least two audio channel signals of the plurality of multi-channel audio signals; a second determiner for determining a first set of encoding parameters based on a smoothing of the set of functions with respect to a frame sequence of the multi-channel audio signal, the smoothing being based on a first smoothing coefficient; a third determiner for determining a second set of encoding parameters based on a smoothing of the set of functions with respect to the frame sequence of the multi-channel audio signal, the smoothing being based on a second smoothing coefficient; an encoding parameter determiner for determining the encoding parameter based on a quality criterion with respect to the first set of encoding parameters and/or the second set of encoding parameters.

Such a multi-channel audio encoder provides an optimum encoding with respect to speed and stability. The strongly smoothed version of the set of functions, e.g. the smoothing based on the first smoothing parameter makes the estimation stable. The weakly smoothed version of the set of functions, e.g. the smoothing based on the second smoothing parameter which is determined at the same time, makes the estimation following the real fast changes of the estimation parameter, i.e. the ITD or the CLD. Memory of the strongly smoothed version of the set of functions is updated by the weakly smoothed version of the set of functions thereby providing the optimum result with respect to tracking speed and stability. The decision which smoothed version to use is based on a quality metric of the first set and/or the second set of encoding parameters. Hence, both, stable and fast parameter estimation is provided.

According to a fifth aspect, the present disclosure relates to a computer program with a program code for performing the method according to the first aspect as such or according to the second aspect as such or according to any of the preceding implementation forms of the first aspect or according to any of the preceding implementation forms of the second aspect when run on a computer.

According to a sixth aspect, the present disclosure relates to a machine readable medium such as a storage, in particular a compact disc, with a computer program comprising a program code for performing the method according to the first aspect as such or according to the second aspect as such or according to any of the preceding claims of the first aspect or according to any of the preceding claims of the second aspect when run on a computer.

Aspects of the present disclosure described above can be used for ITD estimation in a parametric spatial audio encoder. In a parametric spatial audio encoder or parametric multichannel audio encoder, the spatial parameters are extracted and quantized before being multiplexed in the bit stream. The parameter (for instance ITD) may be estimated in frequency domain based on cross correlation. In order to make the estimation more stable, frequency domain cross correlation is strongly smoothed for the parameter (ITD) estimation. In order to follow the real fast changes of the parameter, a weakly smoothed version of frequency domain cross correlation is also calculated at the same time based on an almost instantaneous estimation of the cross correlation by reducing the memory effect.

The weakly smoothed version of the estimation function is used to estimate the parameter (ITD) and to update the cross correlation memory of the strongly smoothed version of the cross correlation in case of changes in the status of the parameter. The decision to use the weakly smoothed version is based on a quality metric of the estimated parameters. The parameter is estimated based on the two versions of the estimation function. The best estimation is kept and if the weakly smoothed function is selected, it is also used to update the strongly smoothed version.

For instance, in the case of ITD estimation, ITD_inst (a weakly smoothed version of ITD) is calculated based on the weakly smoothed version of frequency domain cross correlation. If the standard deviation of ITD_inst over several frequency bin/subbands is lower than a pre-determined threshold, the memory of the strongly smoothed cross correlation will be updated by the one from weakly smoothed version and the ITD estimated with the weakly smoothed function is selected.

A simple quality metric is based on the standard deviation of the weakly smoothed version ITD estimation. Of course, other quality metrics can be similarly used. For instance, a probability of position change can be computed based on all the available spatial information (CLD, ITD, ICC). As one example, the correlation between a fast change of ITD and a fast change of CLD will represent a high probability of modification of the spatial image.

The methods described herein may be implemented as software in a Digital Signal Processor (DSP), in a microcontroller or in any other side-processor or as hardware circuit within an application specific integrated circuit (ASIC).

The present disclosure can be implemented in digital electronic circuitry, or in computer hardware, firmware, software, or in combinations thereof.

BRIEF DESCRIPTION OF THE DRAWINGS

Further embodiments of the present disclosure will be described with respect to the following figures, in which.

DETAILED DESCRIPTION OF EMBODIMENTS OF THE INVENTION

Figure 1A:
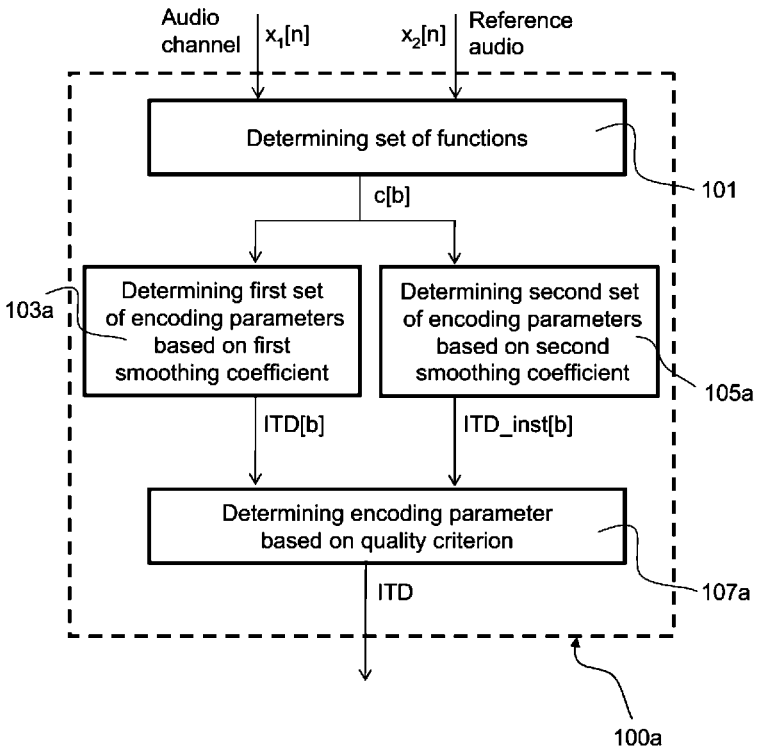
FIG. 1*a* shows a schematic diagram of a method for determining an encoding parameter for an audio channel signal according to an implementation form.

FIG. 1*a* shows a schematic diagram of a method 100*a* for determining an encoding parameter for an audio channel signal according to an implementation form.

The method 100*a* is for determining an encoding parameter ITD, e.g. an inter channel time difference or inter-aural time difference, for an audio channel signal $x_1$ of a plurality of audio channel signals $x_1$, $x_2$ of a multi-channel audio signal. Each audio channel signal $x_1$, $x_2$ comprises audio channel signal values $x_1[n]$, $x_2[n]$. The method 100*a* comprises:

determining 101 for the audio channel signal $x_1$ a set of functions c[b] from the audio channel signal values $x_1[n]$ of the audio channel signal $x_1$ and reference audio signal values $x_2[n]$ of a reference audio signal $x_2$, wherein the reference audio signal is another audio channel signal $x_2$ of the plurality of audio channel signals or a down-mix audio signal derived from at least two audio channel signals $x_1$, $x_2$ of the plurality of multi-channel audio signals;

determining 103*a* a first set of encoding parameters ITD[b] based on a smoothing of the set of functions c[b] with respect to a frame sequence i of the multi-channel audio signal, the smoothing being based on a first smoothing coefficient $SMW_1$;

determining 105*a* a second set of encoding parameters ITD_inst[b] based on a smoothing of the set of functions c[b] with respect to the frame sequence i of the multi-channel audio signal, the smoothing being based on a second smoothing coefficient $SMW_2$; and determining 107*a* the encoding parameter ITD based on a quality criterion with respect to the first set of encoding parameters ITD[b] and/or the second set of encoding parameters ITD_inst[b].

In an implementation form, the determining 107*a* the encoding parameter ITD comprises checking the stability of the second set of encoding parameters ITD_inst[b]. If the second set of encoding parameters ITD_inst[b] is stable over all frequency bins b, selecting the encoding parameter ITD based on the second set of encoding parameters ITD_inst[b] as the final estimation and updating a memory of the smoothing of the set of functions c[b] based on the first smoothing coefficient $SMW_1$ by the smoothing of the set of functions c[b] based on the second smoothing coefficient $SMW_2$. If the second set of encoding parameters ITD_inst [b] is not stable over all frequency bins b, selecting the encoding parameter ITD based on the first set of encoding parameters ITD[b] as the final estimation.

In an implementation form, the method 100*a* comprises the following steps:

Calculate 101*a* first function c[b] and calculate 103*a* the associated smoothed function $c_{sm}[b]$ for the estimation of the parameter ITD from the input signal $x_1[n]$, $x_2[n]$ based on a first smoothing coefficient.

Calculate 105*a* a second smoothed function $c_{sm_inst}[b]$ for the estimation of the parameter ITD from the input signal $x_1[n]$, $x_2[n]$ based on a second smoothing coefficient.

Calculate 107*a* the first and the second estimation of the parameter ITD and $ITD_{inst}$ based on the two smoothed versions $c_{sm}[b]$ and $c_{sm_inst}[b]$ of the estimation function.

Check 107*a* the stability of the second estimation of the parameter $ITD_{inst}$. If the second estimation of the parameter is stable, select the second estimation of the parameter $ITD_{inst}$ as the final estimation and update the memory of the first smoothed function by the second smoothed function. If the second estimation of the parameter is not stable, select the first estimation of the parameter ITD as the final estimation.

In an implementation form, the method 100*a* comprises the following steps:

1. Calculate the FFT of first $x_1[n]$ and second $x_2[n]$ channel signals.
2. Calculate the cross correlation c[n] of those two channels in frequency domain.

2.1. Strongly smoothing of the cross correlation c[n] and calculate the ITD (long time estimation of the inter channel time difference) of each frequency bin (or frequency band) with respect to the first smoothing coefficient, i.e. the long term smoothing coefficient.

2.2. Weak smoothing of the cross correlation c[n] and calculate the ITD_inst (short time estimation of the inter channel time difference) of each frequency bin (or frequency band) with respect to the second smoothing coefficient, i.e. the short term smoothing coefficient.

3. Calculate the mean and standard deviation of ITD_inst.
4. If the standard deviation of ITD_inst is lower than a threshold, update the memory of strongly smoothed cross correlation with the one from the weakly smoothed version, and output the mean of ITD_inst as the final ITD. If the standard deviation of ITD_inst is higher than the threshold, output the mean of ITD as the final ITD.

Figure 1B:
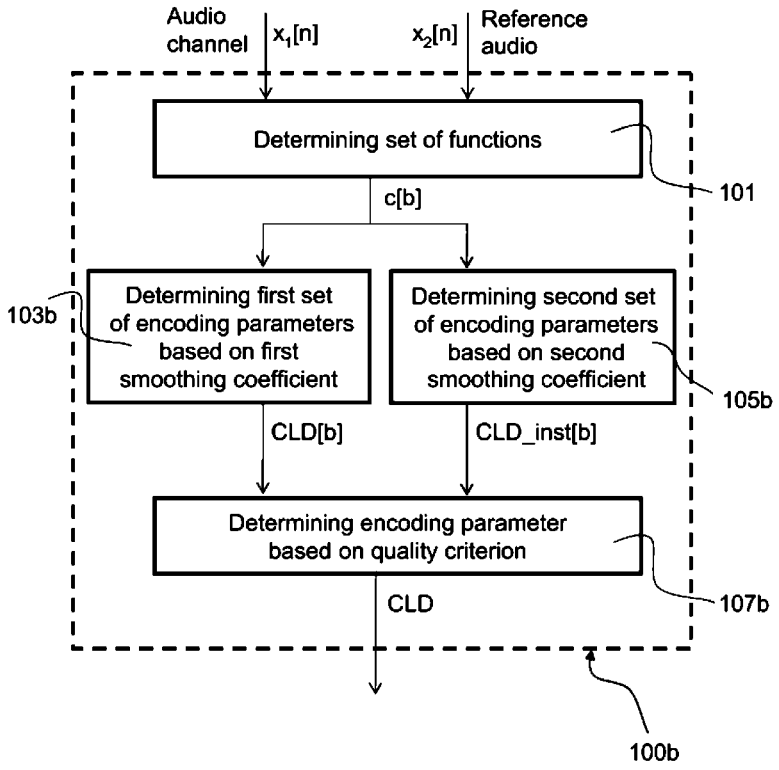
FIG. 1*b* shows a schematic diagram of a method for determining an encoding parameter for an audio channel signal according to an implementation form.

FIG. 1*b* shows a schematic diagram of a method 100*b* for determining an encoding parameter for an audio channel signal according to an implementation form.

The method 100*b* is for determining an encoding parameter CLD, e.g. an inter channel level difference, for an audio channel signal $x_1$ of a plurality of audio channel signals $x_1$, $x_2$ of a multi-channel audio signal. Each audio channel signal $x_1$, $x_2$ comprises audio channel signal values $x_1[n]$, $x_2[n]$. The method 100*b* comprises:

determining 101 for the audio channel signal $x_1$ a set of functions c[b] from the audio channel signal values $x_1[n]$ of the audio channel signal $x_1$ and reference audio signal values $x_2[n]$ of a reference audio signal $x_2$, wherein the reference audio signal is another audio channel signal $x_2$ of the plurality of audio channel signals or a down-mix audio signal derived from at least two audio channel signals $x_1$, $x_2$ of the plurality of multi-channel audio signals;

determining 103*b* a first set of encoding parameters CLD[b] based on a smoothing of the set of functions c[b] with respect to a frame sequence i of the multi-channel audio signal, the smoothing being based on a first smoothing coefficient $SMW_1$;

determining 105*b* a second set of encoding parameters CLD_inst[b] based on a smoothing of the set of functions c[b] with respect to the frame sequence i of the multi-channel audio signal, the smoothing being based on a second smoothing coefficient $SMW_2$; and determining 107*b* the encoding parameter CLD based on a quality criterion with respect to the first set of encoding parameters CLD[b] and/or the second set of encoding parameters CLD_inst[b].

In an implementation form, the determining 107*b* the encoding parameter CLD comprises checking the stability of the second set of encoding parameters CLD_inst[b]. If the second set of encoding parameters CLD_inst[b] is stable over all frequency bins b, selecting the encoding parameter CLD based on the second set of encoding parameters CLD_inst[b] as the final estimation and updating a memory of the smoothing of the set of functions c[b] based on the first smoothing coefficient $SMW_1$ by the smoothing of the set of functions c[b] based on the second smoothing coefficient $SMW_2$. If the second set of encoding parameters CLD_inst[b] is not stable over all frequency bins b, selecting the encoding parameter CLD based on the first set of encoding parameters CLD[b] as the final estimation.

In an implementation form, the method 100*b* comprises the following steps:

Calculate 101*a* first function c[b] and calculate 103*b* the associated smoothed function $c_{sm}[b]$ for the estimation of the parameter CLD from the input signal $x_1[n]$, $x_2[n]$ based on a first smoothing coefficient.

Calculate 105*b* a second smoothed function $c_{sm_inst}[b]$ for the estimation of the parameter CLD from the input signal $x_1[n]$, $x_2[n]$ based on a second smoothing coefficient.

Calculate 107*b* the first and the second estimation of the parameter CLD and $CLD_{inst}$ based on the two smoothed versions $c_{sm}[b]$ and $c_{sm_inst}[b]$ of the estimation function.

Check 107*b* the stability of the second estimation of the parameter $CLD_{inst}$. If the second estimation of the parameter is stable, select the second estimation of the parameter $CLD_{inst}$ as the final estimation and update the memory of the first smoothed function by the second smoothed function. If the second estimation of the parameter is not stable, select the first estimation of the parameter CLD as the final estimation.

In an implementation form, the method 100*b* comprises the following steps:

1. Calculate the FFT of first $x_1[n]$ and second $x_2[n]$ channel signals.
2. Calculate the energy en[n] of those two channels in frequency domain.

2.1. Strong smoothing of the energy en[n] and calculate the CLD (long time estimation of the inter channel level difference) of each frequency bin (or frequency band) with respect to the first smoothing coefficient, i.e. the long term smoothing coefficient.

2.2. Weak smoothing of the energy en[n] and calculate the CLD_inst (short time estimation of the inter channel level difference) of each frequency bin (or frequency band) with respect to the second smoothing coefficient, i.e. the short term smoothing coefficient.

3. Check the stability of stereo image based on CLD_inst.

4. If the stereo image is not stable, update the memory of strongly smoothed energy with the one from the weakly smoothed version, and output CLD_inst as the final CLD. If the stereo image is stable, output CLD as the final CLD.

Figure 2:
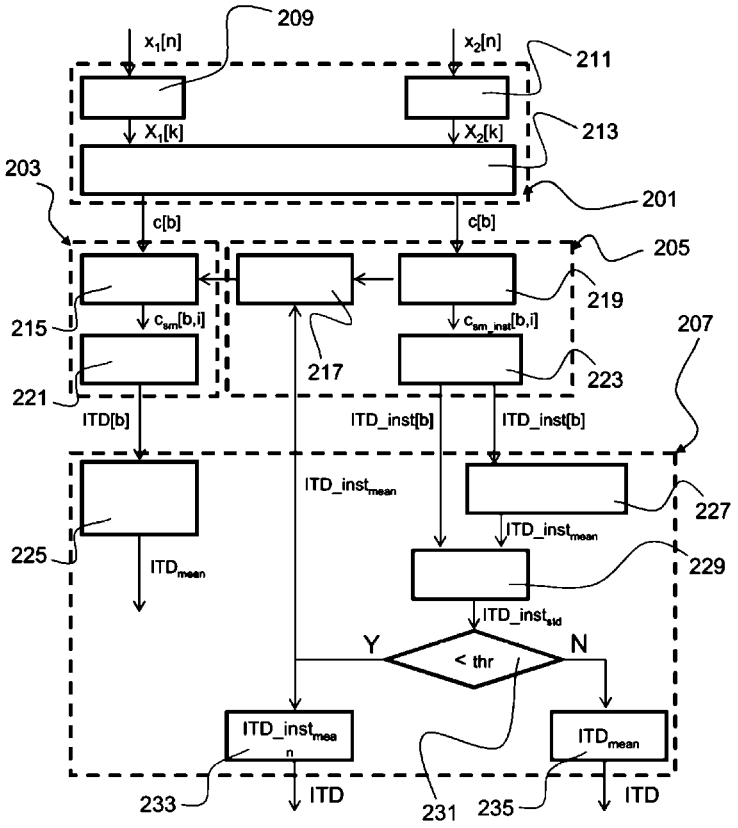
FIG. 2 shows a schematic diagram of an ITD estimation algorithm according to an implementation form.

FIG. 2 shows a schematic diagram of an ITD estimation algorithm 200 according to an implementation form.

In a first step 209, a time frequency transform is applied on the samples of the first input channel $x_1[n]$ obtaining a frequency representation $X_1[k]$ of the first input channel $x_1$. In a second step 211, a time frequency transform is applied on the samples of the second input channel $x_2[n]$ obtaining a frequency representation $X_2[k]$ of the second input channel $x_2$. In the implementation form of stereo input channels, the first input channel $x_1$ may be the left channel and the second input channel $x_2$ may be the right channel. In a preferred embodiment, the time frequency transform is a Fast Fourier Transform (FFT) or a Short Term Fourier Transform (STFT). In an alternative embodiment, the time frequency transform is a cosine modulated filter bank or a complex filter bank.

In a third step 213, a cross-spectrum c[b] is computed from the frequency representations $X_1[k]$ and $X_2[k]$ of the first and second input Channels $x_1$, $x_2$ per sub-band as $$c[b] = \sum_{k=k_b}^{k_{b+1}-1} X_1[k]X_2^*[k]$$

where c[b] is the cross-spectrum of sub-band b. $X_1[k]$ and $X_2[k]$ are the FFT coefficients of the two channels (for instance left and right channels in case of stereo). * denotes complex conjugation. $k_b$ is the start bin of sub-band b and $k_{b+1}$ is the start bin of the adjacent sub-band b+1. Hence, the frequency bins [k] of the FFT from $k_b$ to $k_{b+1}-1$ represent the sub-band [b].

Alternatively, the cross spectrum is calculated for each frequency bin of the FFT as $$c[b]=X_1[b]X_2^*[b]$$

where c[b] is the cross-spectrum of frequency bin [b] and $X_1[b]$ and $X_2[b]$ are the FFT coefficients of the two channels. * denotes complex conjugation. For this case, a sub-band [b] corresponds directly to one frequency bin [k], frequency bin [b] and [k] represent exactly the same frequency bin. The cross spectrum c[b] in this implementation form corresponds to the set of functions c[b] described with respect to FIGS. 1*a* and 1*b*.

In a fourth 215 and fifth step 219, two versions of smoothed cross-spectra $c_{sm}[b,i]$ and $c_{sm_inst}[b,i]$ are calculated from the cross spectrum c[b] as $$c_{sm}[b,i]=SMW_1*c_{sm}[b,i-1]+(1-SMW_1)*c[b]$$

$$c_{sm_inst}[b,i]=SMW_2*c_{sm_inst}[b,i-1]+(1-SMW_2)*c[b]$$

where $SMW_1$ and $SMW_2$ are the respective smoothing factors, and $SMW_1>SMW_2$. i is the frame index of the respective cross-spectra based on the multi-channel audio signal. In an exemplary, but preferred embodiment, $SMW_1=0.9844$ and $SMW_2=0.75$.

In a sixth 221 and seventh step 223 the two versions of the inter-channel time difference ITD and ITD_inst are calculated per bin or per sub-band based on the strongly smoothed cross-spectrum $c_{sm}[b,i]$ and the weakly smoothed cross-spectrum $c_{sm_inst}[b,i]$ respectively as $$ITD[b] = \frac{\angle c_{sm}[b,i]*N}{\pi*b}$$

$$\text{ITD_inst}[b] = \frac{\angle c_{sm_inst}[b,i]*N}{\pi*b}$$

where the operation ∠ is the argument operator to compute the angle of smoothed cross-spectrum. N is the number of FFT bin.

In an eighth step 225, the mean of the strongly smoothed version of the inter-channel time difference ITD is calculated over all the interesting bins (or sub-bands).

$$ITD_{mean} = \frac{\sum_{b=B_1}^{B_2} ITD[b]}{B_2 - B_1}$$

where $B_1$ and $B_2$ are the indices of the first and last bin (or sub-bands) within the interesting frequency region.

In a ninth 227 and tenth step 229, the mean $\text{ITD_inst}_{mean}$ and the standard deviation $\text{ITD_inst}_{std}$ of the weakly smoothed version of the inter-channel time difference ITD_inst are calculated over all the interesting frequency bins (or frequency sub-bands).

$$\text{ITD_inst}_{mean} = \frac{\sum_{b=B_1}^{B_2} \text{ITD_inst}[b]}{B_2 - B_1}$$

$$\text{ITD_inst}_{std} = \frac{\sqrt{\sum_{b=B_1}^{B_2} (\text{ITD_inst}[b] - \text{ITD_inst}_{mean})^2}}{B_2 - B_1}$$

In an eleventh step 231, it is checked by comparison if the standard deviation of the weakly smoothed version of the inter-channel time difference $\text{ITD_inst}_{std}$ is smaller than a threshold (thr): $\text{ITD_inst}_{std}<\text{thr}$. If this is true (Y=yes), the first smoothed function $c_{sm}[b,i]$ is updated in a twelfth step 217 according to $c_{sm}[b,i]=c_{sm_inst}[b,i]$, and the mean $\text{ITD_inst}_{mean}$ of the weakly smoothed version of the inter-channel time difference ITD_inst is output as the final encoding parameter ITD in a thirteenth step 233. If this is not true (N=no), the mean $ITD_{mean}$ of the strongly smoothed version of the inter-channel time difference ITD is output as the final encoding parameter ITD in a fourteenth step 235.

The steps 209, 211 and 213 described above may be represented as a step 201 which corresponds to step 101 as described with respect to FIG. 1*a*. The steps 215 and 221 described above may be represented as a step 203 which corresponds to step 103*a* as described with respect to FIG.

1*a*. The steps 217, 219 and 223 described above may be represented as a step 205 which corresponds to step 105*a* as described with respect to FIG. 1*a*. The steps 225, 227, 229, 231, 233 and 235 described above may be represented as a step 207 which corresponds to step 107*a* as described with respect to FIG. 1*a*.

In a preferred embodiment of the ITD estimation, the encoding parameter ITD is computed based on the two smoothing versions for the inter-channel time difference ITD and ITD_inst where each of the two smoothing versions ITD and ITD_inst is determined based on positive and negative computation of ITD and ITD_inst respectively according to the following implementation:

Counting of positive and negative values of the strongly smoothed version of the inter-channel time difference ITD is performed. The mean and standard deviation of positive and negative ITD are based on the sign of ITD as follows:

$$ITD_{mean_pos} = \frac{\sum_{i=0}^{i=M} ITD(i)}{Nb_{pos}} \text{ where } ITD(i) \geq 0$$

$$ITD_{mean_neg} = \frac{\sum_{i=0}^{i=M} ITD(i)}{Nb_{neg}} \text{ where } ITD(i) < 0$$

$$ITD_{std_pos} = \sqrt{\frac{\sum_{i=0}^{i=M} (ITD(i) - ITD_{mean_pos})^2}{Nb_{pos}}} \text{ where } ITD(i) \geq 0$$

$$ITD_{std_neg} = \sqrt{\frac{\sum_{i=0}^{i=M} (ITD(i) - ITD_{mean_neg})^2}{Nb_{neg}}} \text{ where } ITD(i) < 0$$

where $Nb_{pos}$ and $Nb_{neg}$ are the number of positive and negative ITD respectively. M is the total number of ITDs which are extracted. It should be noted that alternatively, if ITD is equal to 0, it can be either counted in negative ITD or not counted in none of the average.

Figure 7:
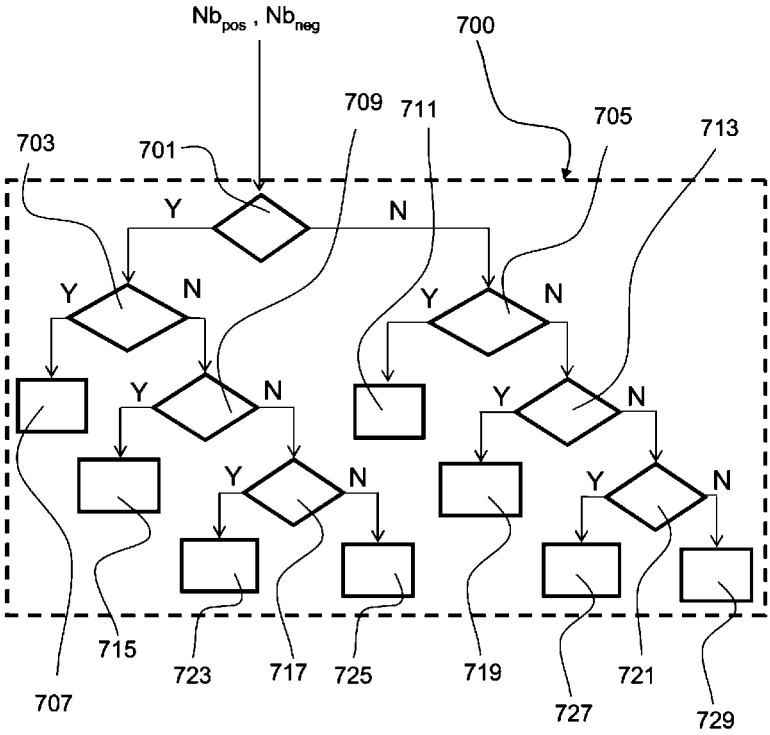
FIG. 7 shows a block diagram of an ITD selection algorithm according to an implementation form.
Figure 8:
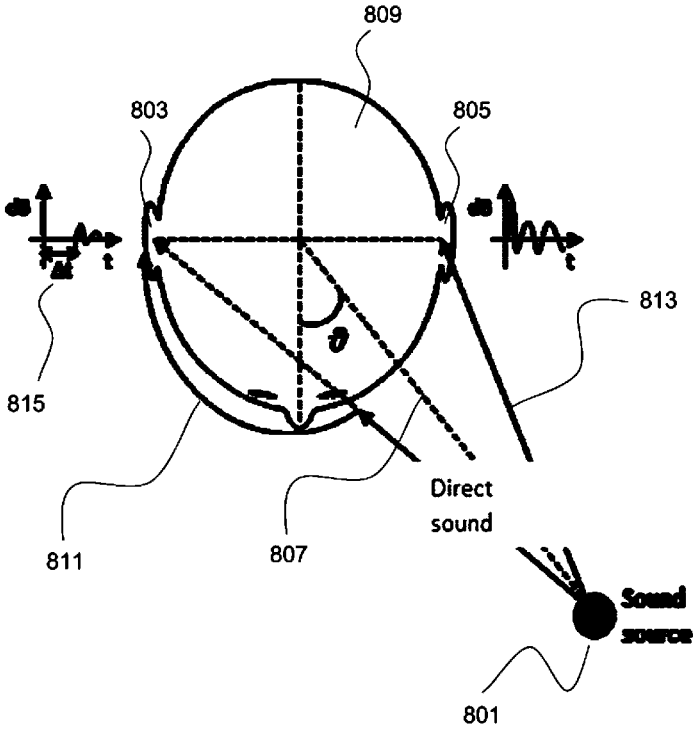
FIG. 8 shows a schematic diagram illustrating the principles of inter-aural time differences.

ITD is selected from positive and negative ITD based on the mean and standard deviation according to the selection algorithm as depicted in FIG. 7.

The same computation is performed for the weakly smoothed version of the inter-channel time difference ITD_inst.

In an implementation form according to an application of the method to the multichannel parametric audio codec, the method 200 comprises the following steps:

In a first and a second step 209 and 211, a time frequency transform is applied on the input channels. In a preferred embodiment, the time frequency transform is a Fast Fourier Transform (FFT) or a Short Term Fourier Transform (STFT). In alternative embodiment, the time frequency transform can be cosine modulated filter bank or a complex filter bank.

In a third step 213, a cross-spectrum of channel j is computed per sub-band as $$c_j[b]=\Sigma_{k=k_b}^{k_{b+1}-1} X_j[k]X^*_{ref}[k]$$

where $c_j[b]$ is the cross-spectrum of bin b or subband b. $X_j[b]$ and $X_{ref}[b]$ are the FFT coefficients of the channel j and reference channel. * denotes complex conjugation. $k_b$ is the start bin of band b and $k_{b+1}$ is the start bin of the adjacent sub-band b+1. Hence, the frequency bins [k] of the FFT from $k_b$ to $k_{b+1}-1$ represent the sub-band [b]. In an implementation form, the spectrum of the reference signal $X_{ref}$ is chosen as one of the channel $X_j$ (for j in [1,M]), and then M−1 spatial cues are calculated in the decoder. In an alternative implementation form, $X_{ref}$ is the spectrum of a mono down-mix signal, which is the average of all M channels, and then M spatial cues are calculated in the decoder. The advantage of using a downmix signal as a reference for a multichannel audio signal is to avoid using a silent signal as reference signal. Indeed the down-mix signal represents an average of the energy of all the channels and is hence less subject to be silent.

In an alternative implementation form, the cross spectrum is computed for each frequency bin of the FFT as:

$$c_j[b]=X_j[b]X_{ref}^*[b]$$

where $c_j[b]$ is the cross-spectrum of frequency bin [b]. $X_{ref}[b]$ is the spectrum of the reference signal and $X_j[b]$(for j in [1,M]) are the spectrum of each channel of the multi-channel signal. * denotes complex conjugation. For this case, a sub-band [b] corresponds directly to one frequency bin [k], frequency bin [b] and [k] represent exactly the same frequency bin.

In a fourth step 215 and a fifth step 219, two version of smoothed cross-spectrum are calculated $$c_{j,sm}[b,i]=SMW_1*c_{j,sm}[b,i-1]+(1-SMW_1)*c_j[b]$$

$$c_{j,sm_inst}[b,i]=SMW_2*c_{j,sm_inst}[b,i-1]+(1-SMW_2)*c_j[b]$$

where $SMW_1$ and $SMW_2$ are the smoothing factor, and $SMW_1>SMW_2$. i is the frame index based on the multi-channel audio signal. In a preferred embodiment, $SMW_1=0.9844$ and $SMW_2=0.75$.

In a sixth step 221 and a seventh step 223, ITD and ITD_inst are calculated per bin or per sub-band based on the strongly smoothed cross-spectrum $c_{sm}$ and weakly smoothed cross-spectrum $c_{sm_inst}$ respectively as:

$$ITD_j[b] = \frac{\angle c_{j,sm}[b, i] * N}{\pi * b}$$

$$\text{ITD_inst}_j[b] = \frac{\angle c_{j,sm_inst}[b, i] * N}{\pi * b}$$

where the operation ∠ is the argument operator to compute the angle of smoothed cross-spectrum. N is the number of FFT bin.

In an eighth step 225, the mean of ITD is calculated over all the interesting bins (or sub-bands).

$$ITD_{mean,j} = \frac{\sum_{b=B_1}^{B_2} ITD_j[b]}{B_2 - B_1}$$

where $B_1$ and $B_2$ are the indices of first and last bin (or sub-bands) within the interesting frequency region.

In a ninth sixth step 227 and a tenth step 229, the mean and the standard deviation of ITD_inst are calculated over all the interesting bins (or sub-bands) as follows:

$$\text{ITD_inst}_{mean,j} = \frac{\sum_{b=B_1}^{B_2} \text{ITD_inst}_j[b]}{B_2 - B_1}$$

-continued $$\text{ITD_inst}_{std,j} = \frac{\sqrt{\sum_{b=B_1}^{B_2} (\text{ITD_inst}_j[b] - \text{ITD_inst}_{mean,j})^2}}{B_2 - B_1}$$

In an eleventh step 231, $\text{ITD_inst}_{std,j}$ is checked being smaller than a threshold thr according to $\text{ITD_inst}_{std,j}$<threshold. If it is smaller (Y path), the first smoothed function is updated in a twelfth step 217 according to $c_{j,sm}[b,i]=c_{j,sm_inst}[b,i]$, and the mean of $\text{ITD_inst}_j$ ($\text{ITD_inst}_{mean,j}$) is output in a thirteenth step 233 as the final ITD. If it is not smaller (N path), the mean of ITD ($\text{ITD}_{mean,j}$) is output in a fourteenth step 235 as the final $\text{ITD}_j$.

In a preferred embodiment of the ITD estimation, the encoding parameter ITD is computed based on the two smoothing versions for the inter-channel time difference ITD and $\text{ITD_inst}_j$ where each of the two smoothing versions $\text{ITD}_j$ and $\text{ITD_inst}_j$ is determined based on positive and negative computation of $\text{ITD}_j$ and $\text{ITD_inst}_j$ respectively according to the following implementation:

Counting of positive and negative values of the strongly smoothed version of the inter-channel time difference ITD is performed. The mean and standard deviation of positive and negative ITD are based on the sign of ITD as follows:

$$ITD_{mean_pos} = \frac{\sum_{i=0}^{i=M} ITD(i)}{Nb_{pos}} \text{ where } ITD(i) \geq 0$$

$$ITD_{mean_neg} = \frac{\sum_{i=0}^{i=M} ITD(i)}{Nb_{neg}} \text{ where } ITD(i) < 0$$

$$ITD_{std_pos} = \sqrt{\frac{\sum_{i=0}^{i=M} (ITD(i) - ITD_{mean_pos})^2}{Nb_{pos}}} \text{ where } ITD(i) \geq 0$$

$$ITD_{std_neg} = \sqrt{\frac{\sum_{i=0}^{i=M} (ITD(i) - ITD_{mean_neg})^2}{Nb_{neg}}} \text{ where } ITD(i) < 0$$

where $Nb_{pos}$ and $Nb_{neg}$ are the number of positive and negative ITD respectively. M is the total number of ITDs which are extracted. It should be noted that alternatively, if ITD is equal to 0, it can be either counted in negative ITD or not counted in none of the average.

ITD is selected from positive and negative ITD based on the mean and standard deviation according to the selection algorithm as depicted in FIG. 7.

Figure 3:
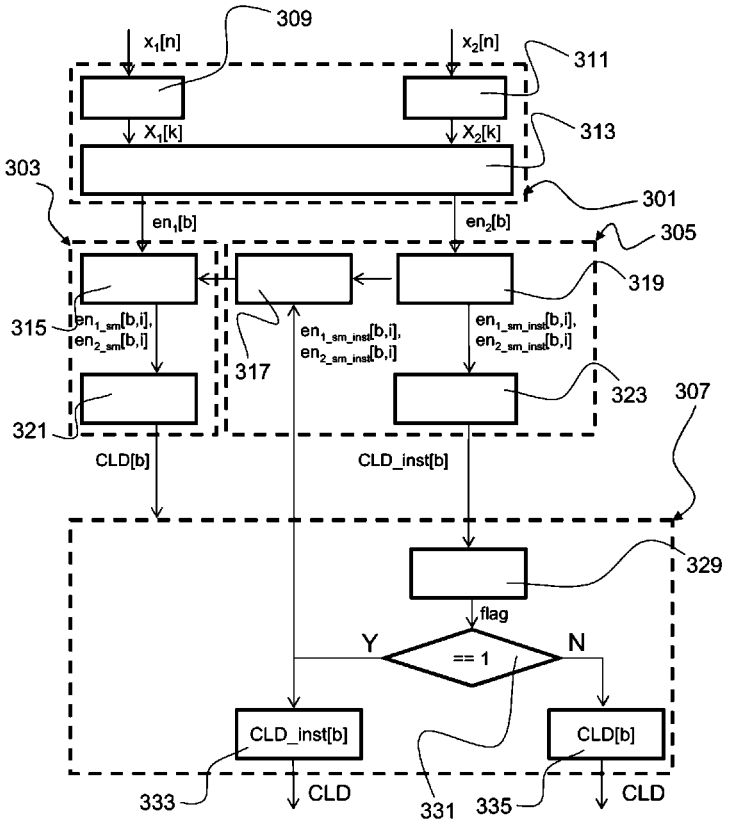
FIG. 3 shows a schematic diagram of a CLD estimation algorithm according to an implementation form.

FIG. 3 shows a schematic diagram of a CLD estimation algorithm according to an implementation form.

In a first step 309, a time frequency transform is applied on the samples of the first input channel $x_1[n]$ obtaining a frequency representation $X_1[k]$ of the first input channel $x_1$. In a second step 311, a time frequency transform is applied on the samples of the second input channel $x_2[n]$ obtaining a frequency representation $X_2[k]$ of the second input channel $x_2$. In the implementation form of stereo input channels, the first input channel $x_1$ may be the left channel and the second input channel $x_2$ may be the right channel. In a preferred embodiment, the time frequency transform is a Fast Fourier Transform (FFT) or a Short Term Fourier Transform (STFT). In an alternative embodiment, the time frequency transform is a cosine modulated filter bank or a complex filter bank.

In a third step 313, the energy $en_1[b]$ of the first channel $x_1$ and the energy $en_2[b]$ of the second channel $x_2$ are computed per sub-band b as $$en_1[b]=\Sigma_{k=k_b}^{k_{b+1}-1} X_1[k]X^*_1[k]$$

$$en_2[b]=\Sigma_{k=k_b}^{k_{b+1}-1} X_2[k]X^*_2[k]$$

where $en_1[b]$ and $en_2[b]$ are the energies of sub-band b. $X_1[k]$ and $X_2[k]$ are the FFT coefficients of the two channels (for instance left and right channels in case of stereo). * denotes complex conjugation. $k_b$ is the start bin of band b and $k_{b+1}$ is the start bin of the adjacent sub-band b+1. Hence, the frequency bins [k] of the FFT from $k_b$ to $k_{b+1}-1$ represent the sub-band [b].

Alternatively, the energies of the two channels $x_1$ and $x_2$ for each frequency bin of the FFT are computed according to:

$$en_1[b]=X_1[b]X_1^*[b]$$

$$en_2[b]=X_2[b]X_2^*[b]$$

where $en_1[b]$ and $en_2[b]$ are the energies of frequency bin [b] of the first and the second channel respectively, $X_1[b]$ and $X_2[b]$ are the FFT coefficients of the two channels. * denotes complex conjugation. For this case, a sub-band [b] corresponds directly to one frequency bin [k], frequency bin [b] and [k] represent exactly the same frequency bin.

In a fourth step 315, a strongly smoothed version $en_{1_sm}[b,i]$ of the energy of the first channel $x_1$ and a strongly smoothed version $en_{2_sm}[b,i]$ of the energy of the second channel $x_2$ is determined and in a fifth step 319 a weakly smoothed version $en_{1_sm_inst}[b,i]$ of the energy of the first channel $x_1$ and a weakly smoothed version $en_{2_sm_inst}[b,i]$ of the energy of the second channel $x_2$ is determined as:

$$en_{1_sm}[b,i]=SMW_1*en_{1_sm}[b,i-1]+(1-SMW_1)*en_1[b]$$

$$en_{1_sm_inst}[b,i]=SMW_2*en_{1_sm_inst}[b,i-1]+(1-SMW_2)*en_1[b]$$

$$en_{2_sm}[b,i]=SMW_1*en_{2_sm}[b,i-1]+(1-SMW_1)*en_2[b]$$

$$en_{2_sm_inst}[b,i]=SMW_2*en_{2_sm_inst}[b,i-1]+(1-SMW_2)*en_2[b]$$

where $SMW_1$ and $SMW_2$ are the smoothing factors or smoothing coefficients, and $SMW_1>SMW_2$, i.e. $SMW_1$ is the strong smoothing factor and $SMW_2$ is the weak smoothing factor. i is the frame index. In an implementation form following the exact evolution of the CLD, $SMW_2$ is set to zero.

In a sixth step 321 and in a seventh step 323, the strongly smoothed version of the inter-channel level difference CLD and the weakly smoothed version of the inter-channel level difference CLD_inst are calculated per bin or per sub-band based on the strongly smoothed energies $en_{1_sm}$ and $en_{2_sm}$ and on the weakly smoothed energies $en_{1_sm_inst}$ and $en_{2_sm_inst}$ respectively, as follows:

$$CLD[b] = 10\log\left(\frac{en_{1_sm}[b]}{en_{2_sm}[b]}\right)$$

$$\text{CLD_inst}[b] = 10\log\left(\frac{en_{1_sm_inst}[b]}{en_{2_sm_inst}[b]}\right)$$

In an eighth step 329, stability of the stereo image is computed based on the weakly smoothed version of the inter-channel level difference CLD_inst. In an implementation form, a stability flag is determined according to the method described in the patent publication "WO 2010/079167 A1", i.e. a sensitivity measure is calculated. The sensitivity measure predicts how sensitive the current frame is to errors in the long term prediction (LTP) filter state due to packet losses. The sensitivity measure is calculated according to the formula:

$$s=0.5PG_{LTP}+0.5PG_{LTP,HP},$$

where $PG_{LTP}$ is the long-term prediction gain, as measured as ratio of the energy of LPC (Linear Predictive Coding) residual signal $r_{LPC}$ and LTP (Long Term Prediction) residual signal $r_{LTP}$, and $PG_{LTP,HP}$ is a signal obtained by running $PG_{LTP}$ through a first order high-pass filter according to:

$$PG_{LTP,HP}(n)=PG_{LTP}(n)-PG_{LTP}(n-1)+0.5PG_{LTP,HP}(n-1).$$

The sensitivity measure is a combination of the LTP prediction gain and a high pass version of the same measure. The LTP prediction gain is chosen because it directly relates the LTP state error with the output signal error. The high pass part is added to put emphasis on signal changes. A changing signal has high risk of giving severe error propagation because the LTP state in encoder and decoder will most likely be very different, after packet loss.

The sensitivity measure will output a flag which shows the stability of the stereo image. In a comparison step 331, the flag is checked being one or zero. If the flag is equal to zero (path N), the stereo image is stable and the inter-channel level differences CLDs have no big change between two consecutive frames. If the flag is equal to one (path Y), the stereo image is not stable, which means that the inter-channel level differences CLDs between two consecutive frames change very fast.

In a ninth step 331, the stability flag is checked which is outputted from the previous step 329. If the stability flag is equal to one (path Y), the memory is updated in a tenth step 317, that is, the strongly smoothed energies are updated by the weakly smoothed energies as follows: $en_{1_sm}[b,i]=en_{1_sm_inst}[b,i]$ and $en_{2_sm}[b,i]=en_{2_sm_inst}[b,i]$, and in an eleventh step 333 the weakly smoothed version of the inter-channel level difference CLD_inst is output as the final encoding parameter CLD. If the stability flag is equal to zero (path N), in a twelfth step 335 the strongly smoothed version of the inter-channel level difference CLD is output as the final encoding parameter CLD.

The steps 309, 311 and 313 described above may be represented as a step 301 which corresponds to step 101 as described with respect to FIG. 1*b*. The steps 315 and 321 described above may be represented as a step 303 which corresponds to step 103*b* as described with respect to FIG. 1*b*. The steps 317, 319 and 323 described above may be represented as a step 305 which corresponds to step 105*b* as described with respect to FIG. 1*b*. The steps 329, 331, 333 and 335 described above may be represented as a step 307 which corresponds to step 107*b* as described with respect to FIG. 1*b*.

Figure 4:
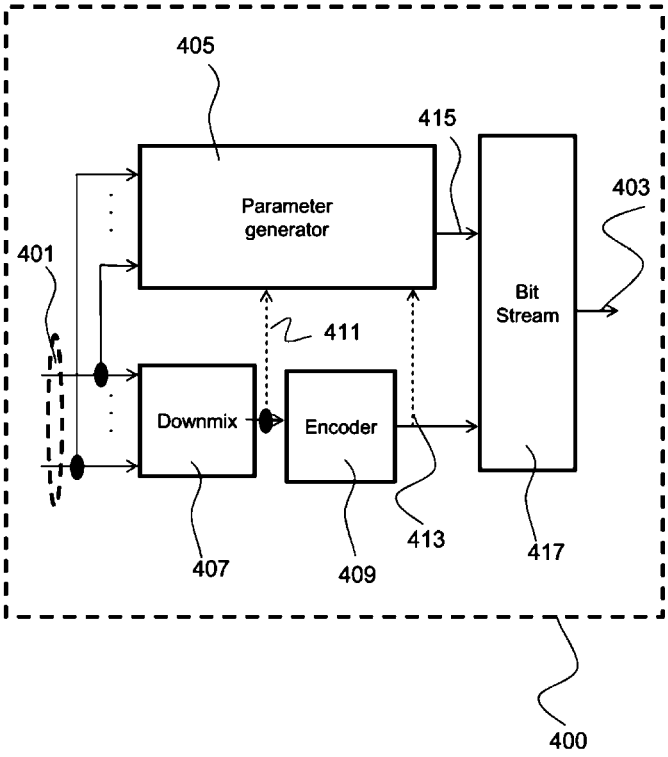
FIG. 4 shows a block diagram of a parametric audio encoder according to an implementation form.

FIG. 4 shows a block diagram of a parametric audio encoder 400 according to an implementation form. The parametric audio encoder 400 receives a multi-channel audio signal 401 as input signal and provides a bit stream as output signal 403. The parametric audio encoder 400 comprises a parameter generator 405 coupled to the multi-channel audio signal 401 for generating an encoding parameter 415, a down-mix signal generator 407 coupled to the multi-channel audio signal 401 for generating a down-mix signal 411 or sum signal, an audio encoder 409 coupled to the down-mix signal generator 407 for encoding the down-mix signal 411 to provide an encoded audio signal 413 and a combiner 417, e.g. a bit stream former coupled to the parameter generator 405 and the audio encoder 409 to form a bit stream 403 from the encoding parameter 415 and the encoded signal 413.

The parametric audio encoder 400 implements an audio coding scheme for stereo and multi-channel audio signals, which only transmits one single audio channel, e.g. the downmix representation of input audio channel plus additional parameters describing "perceptually relevant differences" between the audio channels $x_1, x_2, \ldots, x_M$. The coding scheme is according to binaural cue coding (BCC) because binaural cues play an important role in it. As indicated in the figure, the input audio channels $x_1, x_2, \ldots, x_M$ are down-mixed to one single audio channel 411, also denoted as the sum signal. As "perceptually relevant differences" between the audio channels $x_1, x_2, \ldots, x_M$, the encoding parameter 415, e.g., an inter-channel time difference (ICTD), an inter-channel level difference (ICLD), and/or an inter-channel coherence (ICC), is estimated as a function of frequency and time and transmitted as side information to the decoder 500 described in FIG. 5.

The parameter generator 405 implementing BCC processes the multi-channel audio signal 401 with a certain time and frequency resolution. The frequency resolution used is largely motivated by the frequency resolution of the auditory system. Psychoacoustics suggests that spatial perception is most likely based on a critical band representation of the acoustic input signal. This frequency resolution is considered by using an invertible filter-bank with sub-bands with bandwidths equal or proportional to the critical bandwidth of the auditory system. It is important that the transmitted sum signal 411 contains all signal components of the multi-channel audio signal 401. The goal is that each signal component is fully maintained. Simple summation of the audio input channels $x_1, x_2, \ldots, x_M$ of the multi-channel audio signal 401 often results in amplification or attenuation of signal components. In other words, the power of signal components in the "simple" sum is often larger or smaller than the sum of the power of the corresponding signal component of each channel $x_1, x_2, \ldots, x_M$. Therefore, a down-mixing technique is used by applying the down-mixing device 407 which equalizes the sum signal 411 such that the power of signal components in the sum signal 411 is approximately the same as the corresponding power in all input audio channels $x_1, x_2, \ldots, x_M$ of the multi-channel audio signal 401. The input audio channels $x_1, x_2, \ldots, x_M$ are decomposed into a number of sub-bands. One such sub-band is denoted $X_1[b]$ (note that for notational simplicity no sub-band index is used). Similar processing is independently applied to all sub-bands, usually the sub-band signals are down-sampled. The signals of each sub-band of each input channel are added and then multiplied with a power normalization factor.

Given the sum signal 411, the parameter generator 405 extracts spatial encoding parameters 415 such that ICTD, ICLD, and/or ICC approximate the corresponding cues of the original multi-channel audio signal 401.

When considering binaural room impulse responses (BRIRs) of one source, there is a relationship between width of the auditory event and listener envelopment and IC estimated for the early and late parts of the binaural room impulse responses. However, the relationship between IC or ICC and these properties for general signals and not just the BRIRs is not straightforward. Stereo and multi-channel audio signals usually contain a complex mix of concurrently active source signals superimposed by reflected signal components resulting from recording in enclosed spaces or added by the recording engineer for artificially creating a spatial impression. Different sound source signals and their reflections occupy different regions in the time-frequency plane. This is reflected by ICTD, ICLD, and ICC which vary as a function of time and frequency. In this case, the relation between instantaneous ICTD, ICLD, and ICC and auditory event directions and spatial impression is not obvious. The strategy of the parameter generator 405 is to blindly extract these cues such that they approximate the corresponding cues of the original audio signal.

In an implementation form, the parametric audio encoder 400 uses filter-banks with sub-bands of bandwidths equal to two times the equivalent rectangular bandwidth. Informal listening revealed that the audio quality of BCC did not notably improve when choosing higher frequency resolution. A lower frequency resolution is favorable since it results in less ICTD, ICLD, and ICC values that need to be transmitted to the decoder and thus in a lower bitrate. Regarding time-resolution, ICTD, ICLD, and ICC are considered at regular time intervals. In an implementation form ICTD, ICLD, and ICC are considered about every 4-16 ms. Note that unless the cues are considered at very short time intervals, the precedence effect is not directly considered.

The often achieved perceptually small difference between reference signal and synthesized signal implies that cues related to a wide range of auditory spatial image attributes are implicitly considered by synthesizing ICTD, ICLD, and ICC at regular time intervals. The bitrate required for transmission of these spatial cues is just a few kb/s and thus the parametric audio encoder 400 is able to transmit stereo and multi-channel audio signals at bitrates close to what is required for a single audio channel FIGS. 1*a* and 2 illustrate a method in which ITD is estimated as the encoding parameter 415. FIGS. 1*b* and 3 illustrate a method in which CLD is estimated as the encoding parameter 415.

The parametric audio encoder 400 comprises the down-mix signal generator 407 for superimposing at least two of the audio channel signals of the multi-channel audio signal 401 to obtain the down-mix signal 411, the audio encoder 409, in particular a mono encoder, for encoding the down-mix signal 411 to obtain the encoded audio signal 413, and the combiner 417 for combining the encoded audio signal 413 with a corresponding encoding parameter 415.

The parametric audio encoder 400 generates the encoding parameter 415 for one audio channel signal of the plurality of audio channel signals denoted as $x_1, x_2, \ldots, x_M$ of the multi-channel audio signal 401. Each of the audio channel signals $x_1, x_2, \ldots, x_M$ may be a digital signal comprising digital audio channel signal values denoted as $x_1[n]$, $x_2[n], \ldots, x_M[n]$.

An exemplary audio channel signal for which the parametric audio encoder 400 generates the encoding parameter 415 is the first audio channel signal $x_1$ with signal values $x_1[n]$. The parameter generator 405 determines the encoding parameter ITD from the audio channel signal values $x_1[n]$ of the first audio signal $x_1$ and from reference audio signal values $x_2[n]$ of a reference audio signal $x_2$.

An audio channel signal which is used as a reference audio signal is the second audio channel signal $x_2$, for example. Similarly any other one of the audio channel signals $x_1, x_2, \ldots, x_M$ may serve as reference audio signal. According to a first aspect, the reference audio signal is another audio channel signal of the audio channel signals which is not equal to the audio channel signal $x_1$ for which the encoding parameter 415 is generated.

According to a second aspect, the reference audio signal is a down-mix audio signal derived from at least two audio channel signals of the plurality of multi-channel audio signals 401, e.g. derived from the first audio channel signal $x_1$ and the second audio channel signal $x_2$. In an implementation form, the reference audio signal is the down-mix signal 411, also called sum signal generated by the down-mixing device 407. In an implementation form, the reference audio signal is the encoded signal 413 provided by the encoder 409.

An exemplary reference audio signal used by the parameter generator 405 is the second audio channel signal $x_2$ with signal values $x_2[n]$.

The parameter generator 405 determines a frequency transform of the audio channel signal values $x_1[n]$ of the audio channel signal $x_1$ and a frequency transform of the reference audio signal values $x_2[n]$ of the reference audio signal $x_1$. The reference audio signal is another audio channel signal $x_2$ of the plurality of audio channel signals or a downmix audio signal derived from at least two audio channel signals $x_1$, $x_2$ of the plurality of audio channel signals.

The parameter generator 405 determines inter channel difference for at least each frequency sub-band of a subset of frequency sub-bands. Each inter channel difference indicates a time difference ITD[b] or phase difference IPD[b] or a level difference CLD[b] between a band-limited signal portion of the audio channel signal and a band-limited signal portion of the reference audio signal in the respective frequency sub-band the inter-channel difference is associated to.

An inter-channel phase difference (ICPD) is an average phase difference between a signal pair. An inter-channel level difference (ICLD) is the same as an interaural level difference (ILD), i.e. a level difference between left and right ear entrance signals, but defined more generally between any signal pair, e.g. a loudspeaker signal pair, an ear entrance signal pair, etc. An inter-channel coherence or an inter-channel correlation is the same as an inter-aural coherence (IC), i.e. the degree of similarity between left and right ear entrance signals, but defined more generally between any signal pair, e.g. loudspeaker signal pair, ear entrance signal pair, etc. An inter-channel time difference (ICTD) is the same as an inter-aural time difference (ITD), sometimes also referred to as interaural time delay, i.e. a time difference between left and right ear entrance signals, but defined more generally between any signal pair, e.g. loudspeaker signal pair, ear entrance signal pair, etc. The sub-band inter-channel level differences, sub-band inter-channel phase differences, sub-band inter-channel coherences and sub-band inter-channel intensity differences are related to the parameters specified above with respect to the sub-band bandwidth.

The parameter generator 405 is configured to implement one of the methods as described with respect to FIGS. 1*a*, 1*b*, 2 and 3.

In an implementation form, the parameter generator 405 comprises:

a first determiner determining for the audio channel signal ($x_1$) a set of functions (c[b]) from the audio channel signal values ($x_1[n]$) of the audio channel signal ($x_1$) and reference audio signal values ($x_2[n]$) of a reference audio signal ($x_2$), wherein the reference audio signal is another audio channel signal ($x_2$) of the plurality of audio channel signals or a down-mix audio signal derived from at least two audio channel signals ($x_1$, $x_2$) of the plurality of multi-channel audio signals;

a second determiner for determining a first set of encoding parameters (ITD[b], CLD[b]) based on a smoothing of the set of functions (c[b]) with respect to a frame sequence (i) of the multi-channel audio signal, the smoothing being based on a first smoothing coefficient ($SMW_1$);

a third determiner for determining a second set of encoding parameters (ITD_inst[b], CLD_inst[b]) based on a smoothing of the set of functions (c[b]) with respect to the frame sequence (i) of the multi-channel audio signal, the smoothing being based on a second smoothing coefficient ($SMW_2$); and an encoding parameter determiner for determining the encoding parameter (ITD, CLD) based on a quality criterion with respect to the first set of encoding parameters (ITD[b], CLD[b]) and/or the second set of encoding parameters (ITD_inst[b], CLD_inst[b]).

Figure 5:
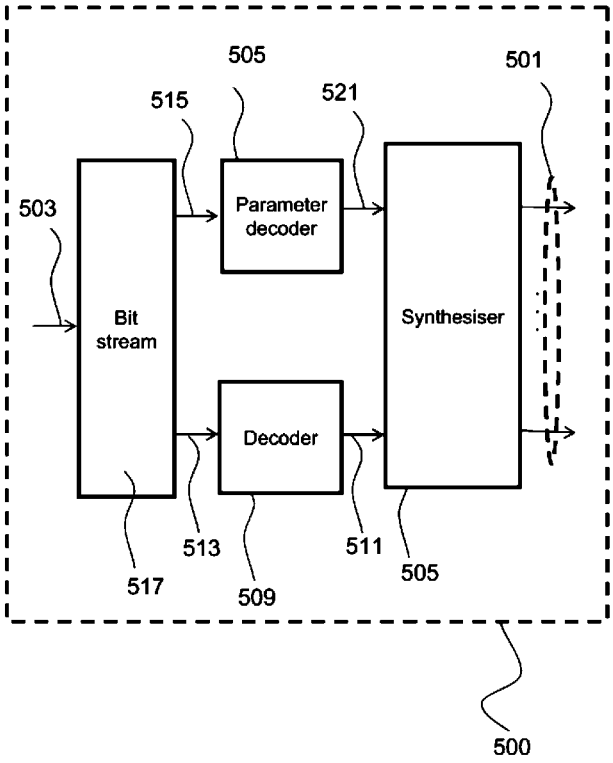
FIG. 5 shows a block diagram of a parametric audio decoder according to an implementation form.

FIG. 5 shows a block diagram of a parametric audio decoder 500 according to an implementation form. The parametric audio decoder 500 receives a bit stream 503 transmitted over a communication channel as input signal and provides a decoded multi-channel audio signal 501 as output signal. The parametric audio decoder 500 comprises a bit stream decoder 517 coupled to the bit stream 503 for decoding the bit stream 503 into an encoding parameter 515 and an encoded signal 513, a decoder 509 coupled to the bit stream decoder 517 for generating a sum signal 511 from the encoded signal 513, a parameter resolver 505 coupled to the bit stream decoder 517 for resolving a parameter 521 from the encoding parameter 515 and a synthesizer 505 coupled to the parameter resolver 505 and the decoder 509 for synthesizing the decoded multi-channel audio signal 501 from the parameter 521 and the sum signal 511.

The parametric audio decoder 500 generates the output channels of its multi-channel audio signal 501 such that ICTD, ICLD, and/or ICC between the channels approximate those of the original multi-channel audio signal. The described scheme is able to represent multi-channel audio signals at a bitrate only slightly higher than what is required to represent a mono audio signal. This is so, because the estimated ICTD, ICLD, and ICC between a channel pair contain about two orders of magnitude less information than an audio waveform. Not only the low bitrate but also the backwards compatibility aspect is of interest. The transmitted sum signal corresponds to a mono down-mix of the stereo or multi-channel signal.

Figure 6:
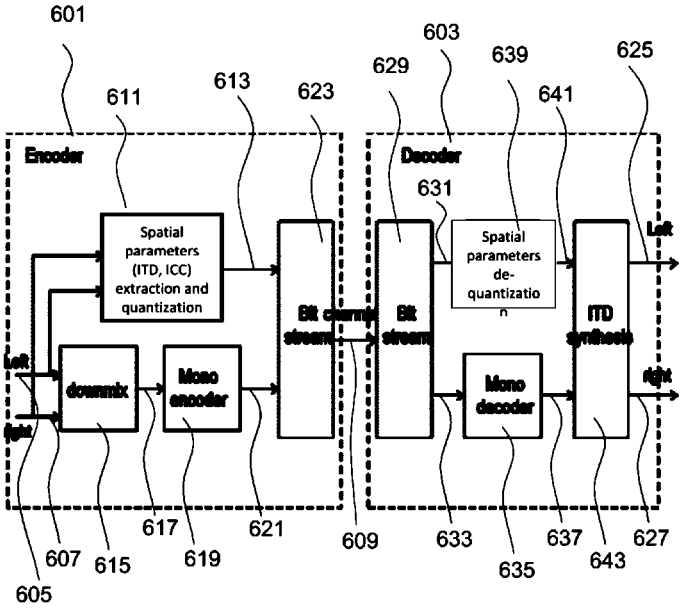
FIG. 6 shows a block diagram of a parametric stereo audio encoder and decoder according to an implementation form.

FIG. 6 shows a block diagram of a parametric stereo audio encoder 601 and decoder 603 according to an implementation form. The parametric stereo audio encoder 601 corresponds to the parametric audio encoder 400 as described with respect to FIG. 4, but the multi-channel audio signal 401 is a stereo audio signal with a left 605 and a right 607 audio channel.

The parametric stereo audio encoder 601 receives the stereo audio signal 605, 607 as input signal and provides a bit stream as output signal 609. The parametric stereo audio encoder 601 comprises a parameter generator 611 coupled to the stereo audio signal 605, 607 for generating spatial parameters 613, a down-mix signal generator 615 coupled to the stereo audio signal 605, 607 for generating a down-mix signal 617 or sum signal, a mono encoder 619 coupled to the down-mix signal generator 615 for encoding the down-mix signal 617 to provide an encoded audio signal 621 and a bit stream combiner 623 coupled to the parameter generator 611 and the mono encoder 619 to combine the encoding parameter 613 and the encoded audio signal 621 to a bit stream to provide the output signal 609. In the parameter generator 611 the spatial parameters 613 are extracted and quantized before being multiplexed in the bit stream.

The parametric stereo audio decoder 603 receives the bit stream, i.e. the output signal 609 of the parametric stereo audio encoder 601 transmitted over a communication channel, as an input signal and provides a decoded stereo audio signal with left channel 625 and right channel 627 as output signal. The parametric stereo audio decoder 603 comprises a bit stream decoder 629 coupled to the received bit stream 609 for decoding the bit stream 609 into encoding parameters 631 and an encoded signal 633, a mono decoder 635 coupled to the bit stream decoder 629 for generating a sum signal 637 from the encoded signal 633, a spatial parameter resolver 639 coupled to the bit stream decoder 629 for resolving spatial parameters 641 from the encoding parameters 631 and a synthesizer 643 coupled to the spatial parameter resolver 639 and the mono decoder 635 for synthesizing the decoded stereo audio signal 625, 627 from the spatial parameters 641 and the sum signal 637.

The processing in the parametric stereo audio decoder 603 is able to introduce delays and modify the level of the audio signals adaptively in time and frequency to generate the spatial parameters 631, e.g., inter-channel time differences (ICTDs) and inter-channel level differences (ICLDs). Furthermore, the parametric stereo audio decoder 603 performs time adaptive filtering efficiently for inter-channel coherence (ICC) synthesis. In an implementation form, the parametric stereo encoder uses a short time Fourier transform (STFT) based filter-bank for efficiently implementing binaural cue coding (BCC) schemes with low computational complexity. The processing in the parametric stereo audio encoder 601 has low computational complexity and low delay, making parametric stereo audio coding suitable for affordable implementation on microprocessors or digital signal processors for real-time applications.

The parameter generator 611 depicted in FIG. 6 is functionally the same as the corresponding parameter generator 405 described with respect to FIG. 4, except that quantization and coding of the spatial cues has been added. The sum signal 617 is coded with a conventional mono audio coder 619. In an implementation form, the parametric stereo audio encoder 601 uses an STFT-based time-frequency transform to transform the stereo audio channel signal 605, 607 in frequency domain. The STFT applies a discrete Fourier transform (DFT) to windowed portions of an input signal x(n). A signal frame of N samples is multiplied with a window of length W before an N-point DFT is applied. Adjacent windows are overlapping and are shifted by W/2 samples. The window is chosen such that the overlapping windows add up to a constant value of 1. Therefore, for the inverse transform there is no need for additional windowing. A plain inverse DFT of size N with time advance of successive frames of W/2 samples is used in the decoder 603. If the spectrum is not modified, perfect reconstruction is achieved by overlap/add.

As the uniform spectral resolution of the STFT is not well adapted to human perception, the uniformly spaced spectral coefficients output of the STFT are grouped into B non-overlapping partitions with bandwidths better adapted to perception. One partition conceptually corresponds to one "sub-band" according to the description with respect to FIG. 4. In an alternative implementation form, the parametric stereo audio encoder 601 uses a non-uniform filter-bank to transform the stereo audio channel signal 605, 607 in frequency domain.

In an implementation form, the downmixer 615 determines the spectral coefficients of one partition b or of one sub-band b of the equalized sum signal Sm(k) 617 by $$S_m(k) = e_b(k)\sum_{c=1}^{C} X_{c,m}(k),$$

where Xc,m(k) are the spectra of the input audio channels 605, 607 and eb(k) is a gain factor computed as $$e_b(k) = \sqrt{\frac{\sum_{c=1}^{C} p\tilde{x}_{c,b}(k)}{p\tilde{x}_b(k)}},$$

with partition power estimates, $$p\tilde{x}_{c,b}(k) = \sum_{m=A_{b-1}}^{A_b-1} |X_{c,m}(k)|^2$$

$$p\tilde{x}_b(k) = \sum_{m=A_{b-1}}^{A_b-1} \left|\sum_{c=1}^{C} X_{c,m}(k)\right|^2.$$

To prevent artifacts resulting from large gain factors when attenuation of the sum of the sub-band signals is significant, the gain factors eb(k) are limited to 6 dB, i.e. eb(k)≤2.

In an implementation form of the parametric stereo audio encoder 601 and decoder 603, the type of ITD information (full-band) is signaled to the remote decoders 603. In an implementation form, the signaling of the type is performed by an implicit signaling by means of auxiliary data transported in at least one bit stream. In an alternative implementation form, the signaling is performed by explicit signaling by means of a flag indicating the type of the respective bit stream. In an implementation form, it is possible to switch between a first signaling option comprising implicit signaling and a second signaling option comprising explicit signaling. In an implementation form of the implicit signaling a flag indicates a presence of the secondary channel information in auxiliary data of at least one backward compatible bit stream. The legacy decoder does not check whether a flag is present or not and does only decode the backward compatible bit stream. For instance, the signaling of the secondary channel bit stream may be included in the auxiliary data of an AAC bit stream. Moreover, the secondary bit stream may also be included in the auxiliary data of an AAC bit stream. In that case, a legacy AAC decoder decodes only the backward compatible part of the bit stream and discards the auxiliary data. In an implementation form of the parametric stereo audio encoder 601 and decoder 603, the presence of such a flag is checked and if the flag is present in the received bit stream the decoder 603 reconstructs the multi-channel audio signal based on the additional full-band ITD information.

In an implementation form of the explicit signaling a flag indicating that the bit stream is a new bit stream obtained with a new not legacy encoder is used. A legacy decoder is not able to decode the bit stream as it does not know how to interpret this flag. However, the decoder 603 according to an implementation form has the ability to decode and to decide to decode either the backward compatible part only or the complete multi-channel audio signal.

A benefit of such a backward compatibility can be seen as follows. A mobile terminal comprising a decoder 603 according to an implementation form can decide to decode the backward compatible part to save the battery life of an integrated battery as the complexity load is lower. Moreover, depending on the rendering system, the decoder 603 can decide which part of the bit stream to decode. For example, for rendering with a headphone, the backward compatible part of the received signal can be sufficient, while the multi-channel audio signal is decoded only when the terminal is connected for example to a docking station with a multi-channel rendering capability.

In an implementation form, the method as described with respect to one of the FIGS. 1*a*, 1*b*, 2 and 3 is applied in an encoder of the stereo extension of ITU-T G.722, G.722 Annex B, G.711.1 and/or G.711.1 Annex D. Moreover, in an implementation form, the method as described with respect to one of the FIGS. 1*a*, 1*b*, 2 and 3 is applied for speech and audio encoder for mobile application as defined in 3GGP EVS (Enhanced Voice Services) codec.

In an implementation form, the method as described with respect to one of the FIGS. 1*a*, 1*b*, 2 and 3 is used for auditory scene analysis. In that case, one of the embodiments of ITD estimation or CLD estimation is used alone or in combination to evaluate the characteristic of the spatial image and to detect the position of the sound source in the audio scene.

FIG. 7 shows a schematic diagram of an ITD selection algorithm according to an implementation form.

In a first step 701, the number $Nb_{pos}$ of positive ITD values is checked against the number $Nb_{neg}$ of negative ITD values. If $Nb_{pos}$ is greater than $Nb_{neg}$, step 703 is performed; If $Nb_{pos}$ is not greater than $Nb_{neg}$, step 705 is performed.

In step 703, the standard deviation $ITD_{std_pos}$ of positive ITDs is checked against the standard deviation $ITD_{std_neg}$ of negative ITDs and the number $Nb_{pops}$ of positive ITD values is checked against the number $Nb_{neg}$ of negative ITD values multiplied by a first factor A, e.g. according to: $(ITD_{std_pos}<ITD_{std_neg})\|(Nb_{pos}>=A*Nb_{neg})$. If $ITD_{std_pos}<ITD_{std_neg}$ or $Nb_{pos}>A*Nb_{neg}$, ITD is selected as the mean of positive ITD in step 707. Otherwise, the relation between positive and negative ITD will be further checked in step 709.

In step 709, the standard deviation $ITD_{std_neg}$ of negative ITDs is checked against the standard deviation $ITD_{std_pos}$ of positive ITDs multiplied by a second factor B, e.g. according to: $(ITD_{std_neg}<B*ITD_{std_pos})$. If $ITD_{std_neg}<B*ITD_{std_pos}$, the opposite value of negative ITD mean will be selected as output ITD in step 715. Otherwise, ITD from previous frame (Pre_itd) is checked in step 717.

In step 717, ITD from previous frame is checked on being greater than zero, e.g. according to "Pre_itd>0". If Pre_itd>0, output ITD is selected as the mean of positive ITD in step 723, otherwise, the output ITD is the opposite value of negative ITD mean in step 725.

In step 705, the standard deviation $ITD_{std_neg}$ of negative ITDs is checked against the standard deviation $ITD_{std_pos}$ of positive ITDs and the number $Nb_{neg}$ of negative ITD values is checked against the number $Nb_{pos}$ of positive ITD values multiplied by a first factor A, e.g. according to: $(ITD_{std_neg}<ITD_{std_pos})\|(Nb_{neg}>=A*Nb_{pos})$. If $ITD_{std_neg}<ITD_{std_pos}$ or $Nb_{neg}>A*Nb_{pos}$, ITD is selected as the mean of negative ITD in step 711. Otherwise, the relation between negative and positive ITD is further checked in step 713.

In step 713, the standard deviation $ITD_{std_pos}$ of positive ITDs is checked against the standard deviation $ITD_{std_neg}$ of negative ITDs multiplied by a second factor B, e.g. according to: ($ITD_{std_pos}$<B*$ITD_{std_neg}$). If $ITD_{std_pos}$<B*$ITD_{std_neg}$, the opposite value of positive ITD mean is selected as output ITD in step 719. Otherwise, ITD from previous frame (Pre_itd) is checked in step 721.

In step 721, ITD from previous frame is checked on being greater than zero, e.g. according to "Pre_itd>0". If Pre_itd>0, output ITD is selected as the mean of negative ITD in step 727, otherwise, the output ITD is the opposite value of positive ITD mean in step 729.

The selection between the ITD based on the strongly smoothed version of the cross-spectrum ($ITD_{mean}$) and the ITD weakly smoothed version of the cross-spectrum ($ITD_{mean_inst}$) is obtained separately for the positive ITD and the negative ITD. Finally, the decision on ITD is done as described in FIG. 7.

From the foregoing, it will be apparent to those skilled in the art that a variety of methods, systems, computer programs on recording media, and the like, are provided.

The present disclosure also supports a computer program product including computer executable code or computer executable instructions that, when executed, causes at least one computer to execute the performing and computing steps described herein.

The present disclosure also supports a system configured to execute the performing and computing steps described herein.

Many alternatives, modifications, and variations will be apparent to those skilled in the art in light of the above teachings. Of course, those skilled in the art readily recognize that there are numerous applications of the present disclosure beyond those described herein. While the aforementioned has been described with reference to one or more particular embodiments, those skilled in the art recognize that many changes may be made thereto without departing from the spirit and scope thereof. It is therefore to be understood that within the scope of the appended claims and their equivalents, the present disclosure may be practiced otherwise than as specifically described herein.

What is claimed is:

1. A method for determining an encoding parameter for an audio channel signal of a plurality of audio channel signals of a multi-channel audio signal, each audio channel signal having audio channel signal values, the method comprising:

determining for the audio channel signal a set of functions from the audio channel signal values of the audio channel signal and reference audio signal values of a reference audio signal, wherein the reference audio signal is another audio channel signal of the plurality of audio channel signals or a down-mix audio signal derived from at least two audio channel signals of the multi-channel audio signal;

determining a first set of encoding parameters based on a smoothing of the set of functions with respect to a frame sequence of the multi-channel audio signal, the smoothing being based on a first smoothing coefficient;

determining a second set of encoding parameters based on a smoothing of the set of functions with respect to the frame sequence of the multi-channel audio signal, the smoothing being based on a second smoothing coefficient; and determining the encoding parameter based on a quality criterion with respect to at least one of the first set of encoding parameters and the second set of encoding parameters.

2. The method of claim 1, wherein the determining the set of functions comprises:

determining a frequency transform of the audio channel signal values of the audio channel signal;

determining a frequency transform of the reference audio signal values of the reference audio signal;

determining the set of functions as a cross spectrum or a cross correlation for at least each frequency sub-band of a subset of frequency sub-bands, each function of the set of functions being computed between a band-limited signal portion of the audio channel signal and a band-limited signal portion of the reference audio signal in the respective frequency sub-band that the function of the set of functions is associated to.

3. The method of claim 2, wherein a frequency sub-band comprises at least one frequency bin.

4. The method of claim 1, wherein the first and second sets of encoding parameters comprise inter channel differences, and the inter channel differences comprise inter channel time differences.

5. The method of claim 1, wherein the determining the encoding parameter based on the quality criterion comprises determining a stability parameter, which is used by the quality criterion.

6. The method of claim 5, wherein the determining the encoding parameter comprises:

determining a stability parameter of the second set of encoding parameters based on a comparison between consecutive values of the second set of encoding parameters with respect to the frame sequence; and determining the encoding parameter depending on the stability parameter of the second set of encoding parameters.

7. The method of claim 5, wherein the stability parameter is based at least on a standard deviation of the second set of encoding parameters.

8. The method of claim 6, wherein the stability parameter is determined over one frame or over multiple frames of the multi-channel audio signal.

9. The method of claim 6, wherein the determining the encoding parameter is determined based on a threshold crossing of the stability parameter of the second set of encoding parameters.

10. The method of claim 9, further comprising:

updating the first set of encoding parameters with the second set of encoding parameters if the stability parameter crosses the threshold.

11. The method of claim 1, wherein the smoothing of the set of functions based on the first and the second smoothing coefficient is computed as an addition of a memory state of a first and a second smoothed versions of the set of functions multiplied by a first coefficient based on the first and the second smoothing coefficient and the set of functions multiplied by a second coefficient based on the first and the second smoothing coefficient.

12. The method of claim 11, further comprising:

updating the memory state of the first smoothed version of the set of functions with the memory state of the second smoothed version of the set of functions if the stability parameter crosses the threshold.

13. The method of claim 1, wherein the first smoothing coefficient is higher than the second smoothing coefficient.

14. A computer program with a program code for performing the method of claim 1 when run on a computer.

15. The method of claim 1, wherein the inter channel differences comprise inter channel level differences.

16. A multi-channel audio encoder for determining an encoding parameter for an audio channel signal of a plurality of audio channel signals of a multi-channel audio signal, each audio channel signal having audio channel signal values, the multi-channel audio encoder comprising:

a first determiner determining for the audio channel signal a set of functions from the audio channel signal values of the audio channel signal and reference audio signal values of a reference audio signal, wherein the reference audio signal is another audio channel signal of the plurality of audio channel signals or a down-mix audio signal derived from at least two audio channel signals of a plurality of multi-channel audio signals;

a second determiner for determining a first set of encoding parameters based on a smoothing of the set of functions with respect to a frame sequence of the multi-channel audio signal, the smoothing being based on a first smoothing coefficient;

a third determiner for determining a second set of encoding parameters based on a smoothing of the set of functions with respect to the frame sequence of the multi-channel audio signal, the smoothing being based on a second smoothing coefficient; and an encoding parameter determiner for determining the encoding parameter based on a quality criterion with respect to at least one of the first set of encoding parameters and the second set of encoding parameters.

* * * * *